United States Patent [19]

Graham et al.

[11] Patent Number: 5,070,629

[45] Date of Patent: Dec. 10, 1991

[54] SWEET SPOT SOLE CONSTRUCTION

[75] Inventors: Kenneth D. Graham, Stoneham; Bernie Allen, Jamaica Plain; Edward Tavino, Swampscott, all of Mass.; Kenton Geer, Exeter; Gary J. Troy, Nottingham, both of N.H.; Stephen Francis, Newburyport, Mass.

[73] Assignee: Hyde Athletic Industries, Inc., Peabody, Mass.

[21] Appl. No.: 427,764

[22] Filed: Oct. 26, 1989

[51] Int. Cl.[5] ..... A43B 23/08

[52] U.S. Cl. ..... 36/27; 36/28; 36/69; 36/7.8

[58] Field of Search ..... 36/27, 28, 35 R, 7.8, 36/37, 38, 7.3, 25 R, 114, 69, 122

[56] References Cited

U.S. PATENT DOCUMENTS

| | | | |
|---|---|---|---|
| 2,913,837 | 11/1959 | Geuder | 36/37 |
| 3,798,801 | 3/1974 | Gros-Louis | 36/122 |
| 4,327,504 | 5/1982 | Welsch | 36/122 |
| 4,506,460 | 3/1985 | Ridy | 36/28 |
| 4,598,487 | 7/1986 | Misevich | 36/28 |
| 4,709,489 | 12/1987 | Welter | 36/38 |
| 4,771,554 | 9/1988 | Hannemann | 36/38 |
| 4,815,221 | 3/1989 | Diaz | 36/38 |
| 4,878,301 | 11/1989 | Kiyosawa | 36/69 |
| 4,910,887 | 3/1990 | Turner et al. | 36/114 |

FOREIGN PATENT DOCUMENTS

| | | | |
|---|---|---|---|
| 72214 | 1/1943 | Czechoslovakia | 36/28 |

*Primary Examiner*—Steven N. Meyers
*Attorney, Agent, or Firm*—Wolf, Greenfield & Sacks

[57] ABSTRACT

A shoe construction having an energy return system together with features providing cushinoning and stability. The energy return system includes a rigid frame having a torsional rigidity bar in the midfoot area integrally connecting annular walls in the forefoot and heel areas of the midsole. A net of monofilaments or fibers is secured under tension in the areas defined by the annular walls with the net positioned over an open area in the midsole. A cantilevered system of support pads is positioned in the arch area to support the medial side of the midfoot.

26 Claims, 11 Drawing Sheets

FIG. 9
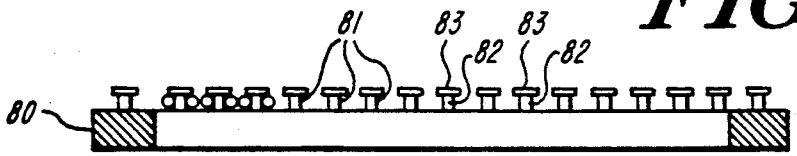
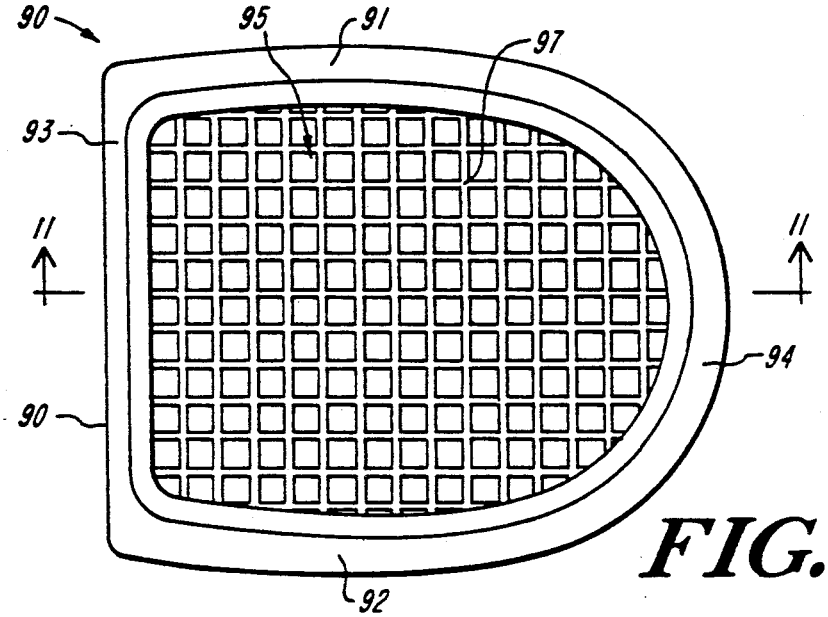
FIG. 10
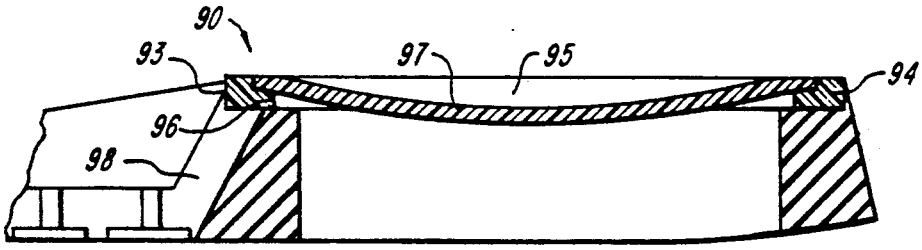
FIG. 11
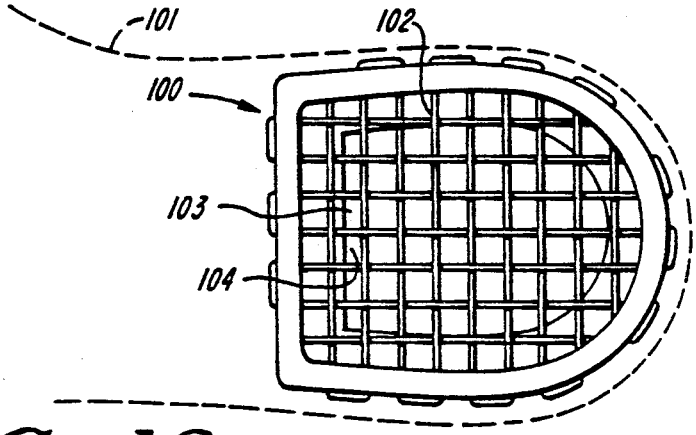
FIG. 12

SWEET SPOT SOLE CONSTRUCTION

SUBJECT MATTER OF INVENTION

The present invention relates to a shoe construction and more particularly to a shoe having means for imparting energy return characteristics to the shoe.

BACKGROUND OF INVENTION

There has been recent interest in improving performance characteristics of athletic and walking shoes. Initially these efforts were primarily directed to improving cushioning and shock absorption. Improvement of these characteristics was materially assisted with the development of a range of synthetic materials particularly useful in footwear manufacture. Most recently, microcellular closed cell material of selected compressibilities such as ethylene vinyl acetate (EVA) and improved polyurethane systems has been used in the commercial manufacture of a variety of midsole and wedge components intended to improve the comfort, cushioning and shock absorption of footwear. Commercially available footwear using such material now include components to improve the stability and biomechanics of the footwear. Such components as motion control devices and torsional rigidity bars are also now common components in such commercial products.

The most recent industry interest relates to the manufacture of footwear having energy return characteristics. This interest has also been enhanced by the common availability of EVA and other microcellular foam materials for use as resilient cushioning material. Such material has the characteristic of absorbing energy in the compression phase of a gait cycle and releasing the energy as the compression is released. The absorbed energy is released in the push-off phase of the gait cycle in running or walking.

Other energy return systems have contemplated the use of thermoplastic hollow tubes or shapes encapsulating a fluid or gas such as a Freon. These encapsulations are strategically located in the midsole or elsewhere to provide an energy return mechanism to the shoe.

Still other systems contemplate the use of such commercially available materials as Hytrel and Kevlar in various blends, compositions and molded arrangements positioned in the arch and/or medial portion of the shoe providing mechanical cushioning and energy storage.

There has been some use of netting or mesh arrangements in selected portions of a sole construction for various purposes. Insofar as the applicant is aware, the earliest of such efforts was in the form of a fine woven wire fabric described in U.S. Pat. No. 812,496 issued Feb. 13, 1906. Mesh used in that construction, however, provided only stiffness and wearing qualities at the bottom of the heel. That patent failed to suggest arranging the mesh under appropriate tension and thus fails to teach or suggest the use of such mesh in an energy return system.

A second disclosure of a mesh construction is contained in U.S. Pat. No. 1,650,466 issued Nov. 22, 1927. In that construction, a fabric of mesh is used to retain the shape of a component and does to act as an energy return system such as a spring or the like.

Most recently, U.S. Pat. No. 4,297,796 issued Nov. 3, 1981, discloses the use of an open work support or netting of stretch resistant threads secured to the top side of a flexibly deformable sole layer. This netting structure is intended to distribute shock stresses in the heel or ball of the foot. Since that open mesh is three-dimensional, it redistributes deformation of the sole structure under compression and does not function as a spring-like energy return system.

Similarly, a more recent disclosure in U.S. Pat. No. 4,608,768 issued Sept. 2, 1986 discloses the use of an open work structure embedded in a resilient member with plugs arranged within the openings of the open work structure. In such an arrangement, different shock absorbing characteristics may be imparted to selected portions of the sole structure. The mesh arrangement, itself, however does not appear to be used as a spring-like energy return system.

Other references in which various midsole structures having related arrangements include, U.S. Pat. Nos. 3,808,713, 4,179,826, 4,263,728, 4,451,994, 4,507,879, 4,566,206, 4,753,021, and 4,774,774.

Insofar as the applicant is aware, no efforts have been made to use a mesh or net-like structure as a means for imparting energy return characteristics in footwear. Prior efforts directed toward energy return systems have, insofar as the applicant is aware, centered upon the use of macro and microcellular structures in which energy is stored in a fluid system under compression and thereafter released during expansion of the fluid component. Such arrangements have a variety of limitations. Nor is applicant aware of using a mesh-like arrangement in combination with a frame shaped to provide added functions and features including cushioning and stability.

SUMMARY OF INVENTION

It is an object of the present invention to provide an improved and alternate means for imparting energy return characteristics to a shoe.

A further object of the present invention is to provide an improved shoe construction particularly useful for athletic activities that incorporates a spring-like system in selected areas of the heel and forefoot portion for purposes of storing energy in running and/or jumping during compression portions of the gait cycle and for releasing energy during the push-off phase of the gait cycle.

A further object of the present invention is to provide an improved energy return system for footwear which does not require the use of currently popular gas or fluid filled tubes or chambers.

A further object of the present invention is to provide a footwear construction with energy return characteristic that may be used in a wide range of footwear, including shoes designed for walking and various sporting activities, such as running, basketball, aerobics and the like.

Another object of the present invention is to provide an improved energy return system for use in footwear constructions that can be specifically tuned to meet particular needs of individuals and particular requirements of different sporting activities.

A further object of the present invention is to provide an improved energy return system incorporated into a shoe that reduces the weight of the shoe by eliminating portion of the midsole material.

Still another object of the present invention is to provide an energy return system for footwear which may be visibly incorporated into shoes to enhance the marketability of the footwear.

One more object of the present invention is to provide an energy return system for footwear that is readily manufactured to consistent standards.

A further object of the present invention is to provide an energy return system in which the compression set of the midsole component is minimized by shaping the system to assure the uniform distribution of forces on the components and to minimize internal friction.

Another object of the present invention is to provide an improved energy return system in the form of a mesh or net secured under tension in a plane parallel to the sole and over an open or void area in the heel and forefoot portion of the sole structure for energy storage during heel engagement and push-off in the gait cycle as well as in jumping and/or running.

One more advantage of the present invention is to provide an improved energy return system that incorporates a frame supporting mesh or net components, both in the heel and forepart region of the shoe. Such mesh or net components are maintained under tension to impart spring-like qualities which absorb energy during compression and release it during the push-off portion of the gait cycle.

A further object of the present invention is to provide an energy return system that incorporates additional features of motion control and torsional rigidity through integrally formed members of the structure.

DETAILED DESCRIPTION OF DRAWINGS

These and other objects and advantages of the present invention will be more clearly understood when considered in conjunction with accompanying drawings in which:

FIG. 9 is a cross-sectional detail taken along the line 9—9 of FIG. 8;

FIG. 10 is a top-plan view of a heel component illustrating another embodiment of the invention;

FIG. 11 is a cross-sectional detail taken substantially along the line 11—11 of FIG. 10, but in addition showing further components of a midsole construction.

FIG. 12 is a top-plan view of a heel component illustrating still another embodiment of this invention;

DETAILED DESCRIPTION OF A PREFERRED EMBODIMENT

The energy return system of the present invention includes the use of components in the midsole region which provide both cushioning and energy return characteristics. These components may be selectively embodied in the heel, midfoot and/or forepart of the midsole to achieve desired energy return characteristics designed for a particular type of shoe. Thus components may be especially designed for use in walking shoes or various specific types of athletic shoes such as basketball or running shoes.

Figure 1:
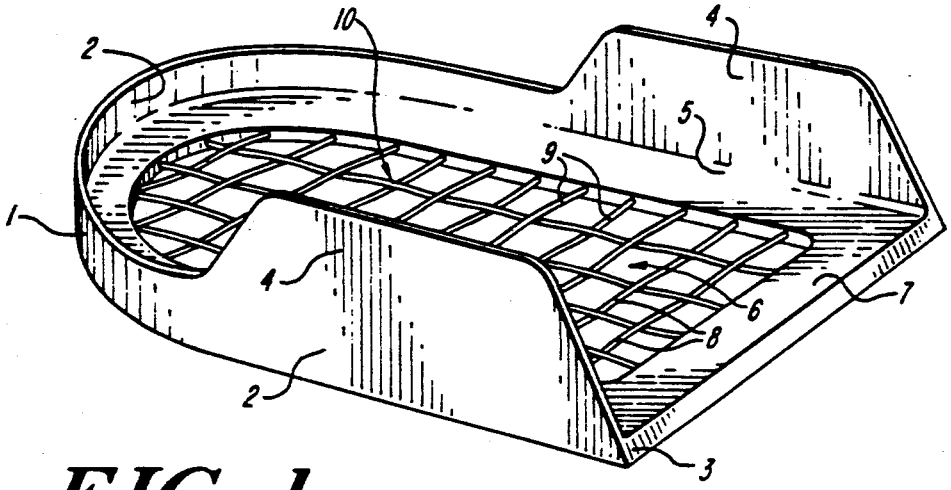
FIG. 1 is a perspective view of a rigid heel frame embodying components of the invention.

Referring first to the embodiment illustrated in FIG. 1, there is illustrated a rigid frame 1 designed to be incorporated in a midsole construction. This rigid frame 1 is shaped to fit in the heel region of the shoe preferably above and permanently secured to a midsole member (not shown). The frame 1 is a stabilizing member having an upwardly extending flange or sidewall 2 about its periphery from the lateral side, extending about the heel forwardly to the forward portion of the heel on the medial side at the arch area 3. The upwardly extending flange 2 has a greater height along a length 4 at its forward ends defining motion control device that is intended to impart greater stability to the heel. An inwardly extending flange 5 is continuous with the lower edge of the upwardly extending flange 2, defining an open area 6. The forward end of the open area 6 is defined by a lateral flange 7 which is continuous with the forward ends of flange 5. A plurality of fibers 8 and 9, which may be of nylon or other suitable filaments used for tennis racquets, are woven into a grid or net positioned in the plane of the flanges 5 and 7. The fibers 8 and 9 have their respective ends anchored and suitably locked into the frames 5 and 7 so that the grid or net 10 is taut and thereby forms a spring-like member which is highly resilient. The ends of the fibers 8 and 9 may be suitably locked to the rigid frame by suitable means. For example, the fibers 8 and 9 may be enlarged, bent or knotted at the ends before being positioned in a mold from which the rigid frame is formed. The fibers should not have any slack. Alternately, the ends may be ultrasonically or otherwise welded to the frame. In this procedure the frame is formed with an upper and lower half between which is sandwiched the preassembled mesh with its ends lying in aligned grooves in the facing surfaces of the two halves. The unit is ultrasonically welded together in a suitable sequence as a sandwich. The rigid frame 1 is thus molded with the enlarged ends of the fibers 8 and 9 molded into the flanges 5 and 7 as illustrated. As an alternative means, the fibers 8 and 9 may be molded simultaneously with the frame. However, this may not be as desirable as using a separate grid molded into the frame.

The frame 1 must be made a of a stiff or semi-resilient material to permit the frame and the fibers be maintained under taut conditions. Under some conditions the fibers may be maintained under tension. This frame may be compounded from a variety of plastic such as high impact thermosetting plastic or in combination with material such as commercially available Kevlar. The fibers may be formed of a reinforced material or material having significant tensile strength characteristics, such as nylon monofilament or boron or graphite composite filaments in order to achieve both characteristics of stability and shock attenuation.

Figure 2:
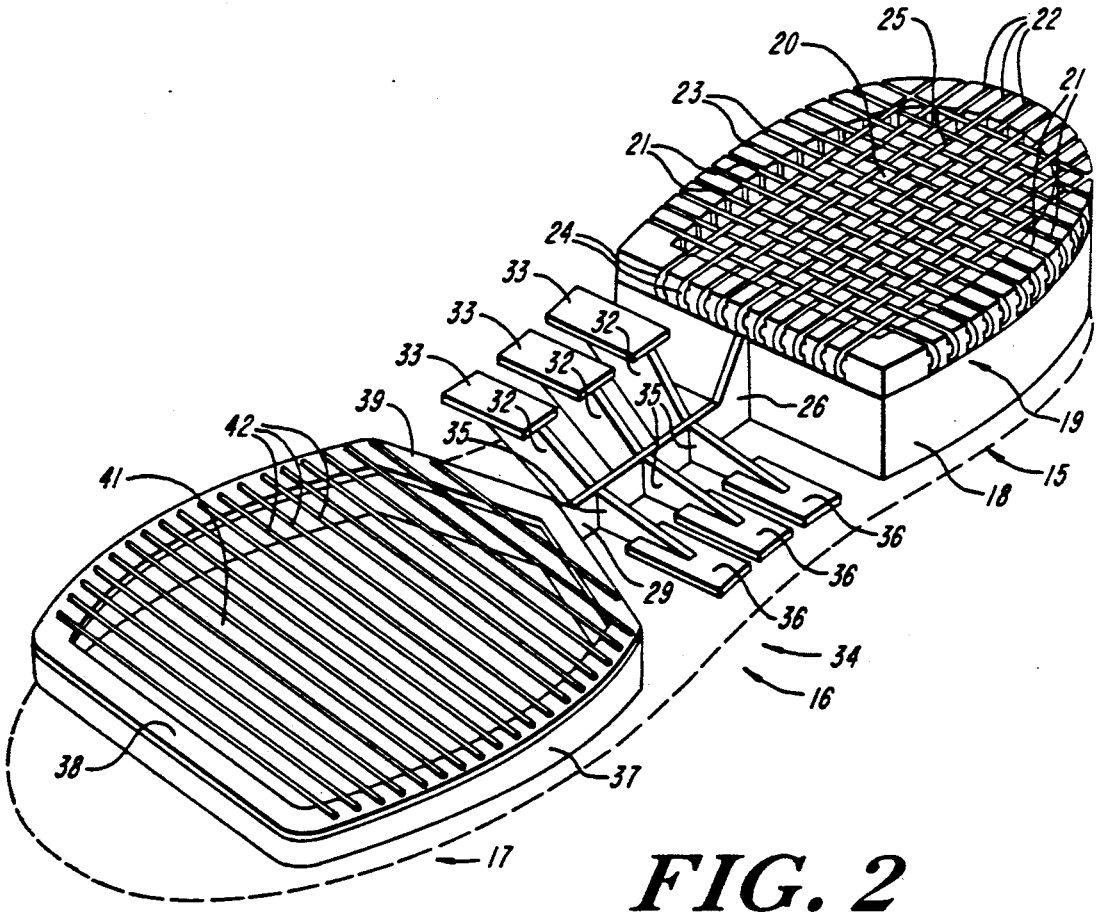
FIG. 2 is a perspective view of a midsole construction embodying features of the invention with portions in dotted outline.

Referring to FIGS. 2 to 5 there is illustrated a midsole construction embodying features of the present invention in both the heel and forepart portion of the midsole. In this arrangement, there is provided a midsole structure having a heel assembly 15, an instep assembly 16, and a forefoot assembly 17. The heel assembly 15 includes a cushion 18 of resilient compressible material such as a microcellular filled closed cell foam, preferably a polyurethane (PU) or an ethyl vinyl acetate (EVA) material of uniform thickness from the rear of the heel to the instep region. The compressibility selected for this cushion 18 depends upon the particular purpose for which the shoe is designed. Thus, for example, it may have a durometer in the order of 30 to 45 Shore A. The cushion of this midsole has secured to it the rigid heel frame 19. This rigid heel frame 19 is preferably formed of a uniformly thick wall member defining an open area 20 within the frame 19. The frame 19 is formed of a wall with a series of uniformly spaced slots or grooves 21 in the upper, lower, and outer surface of the frame wall. These slots 21 are arranged in two groups with one group 22 extending longitudinally of the midsole and the other group 23 extending transversely of the midsole to form a grid or net 25 in the open area 20. The fibers forming the groups 22 and 23 are each a filament material which may be of the type suitable for making tennis rackets. Nylon monofilaments or boron and graphite reinforced fibers are believed to be suitable for such purposes. The filaments forming each of the groups, 22, 23, are formed as endless fiber loops 24 which are interwoven as illustrated in FIG. 2 into net 25, with the ends of the groups 22 and 23 positioned within opposite and aligned slots 21 that lock these groups into the positions illustrated. The rigid heel frame 19 is secured to the upper surface of the cushion 18 by conventional means such as cement.

A rigid frame of the construction illustrated in FIG. 1 is also contemplated and may be substituted for the rigid heel frame 19 in FIGS. 2 through 5.

Although the cushion 18 is described as formed of a resilient compressible material of the type conventionally used for midsole constructions, its upper surface should be recessed sufficiently to provide a void or an air space below the lower surface of the net 25. Alternately, the cushion 18 may be formed of an EVA or PU material in a range of durometers from Shore 25A to Shore 45A with an annular wall defining a void or an opening, corresponding in shape to and aligned below the open area 20. This void or opening in the midsole beneath the net 25 has a relevant function with respect to cushioning, energy return and motion control. Its location also helps stabilize the foot during the gait cycle.

Figure 3:
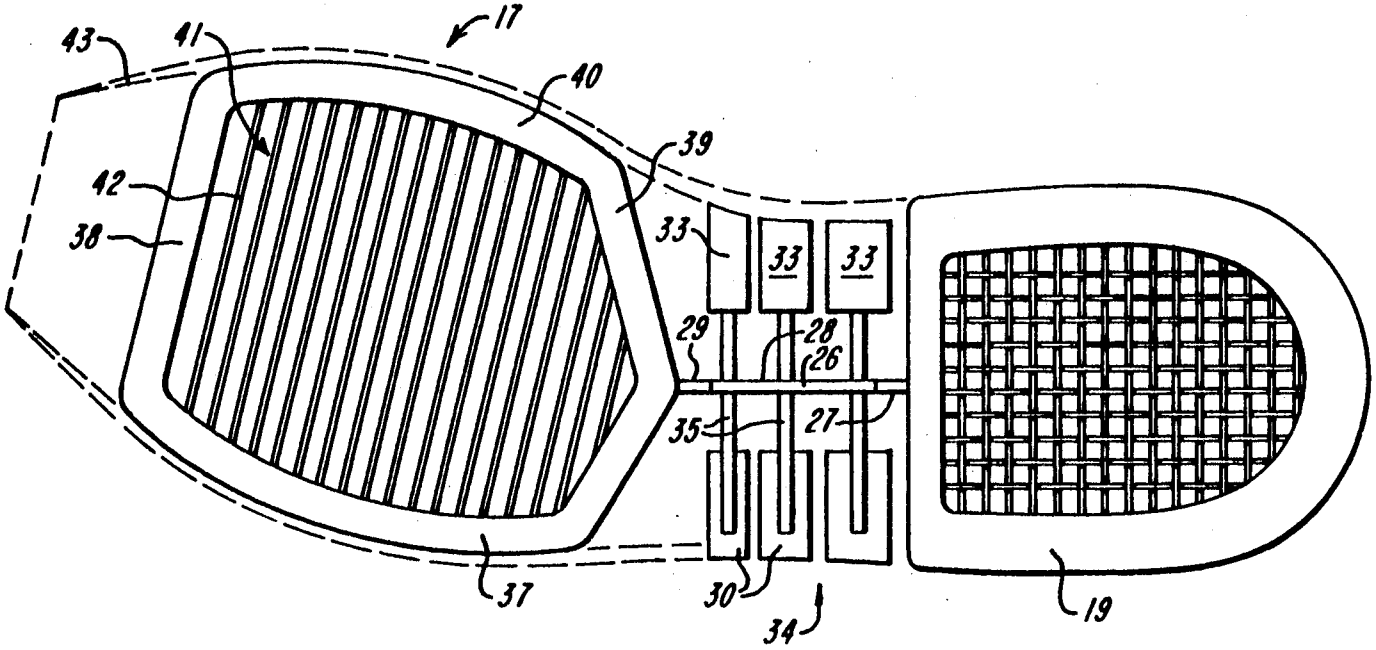
FIG. 3 is a top-plan view of the embodiment of FIG. 2.
Figure 4:
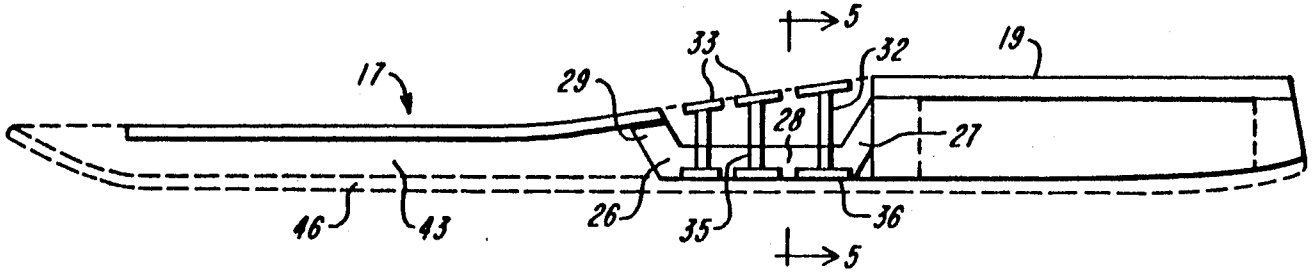
FIG. 4 is a side-elevational view of the embodiment of FIGS. 2 and 3.
Figure 5:
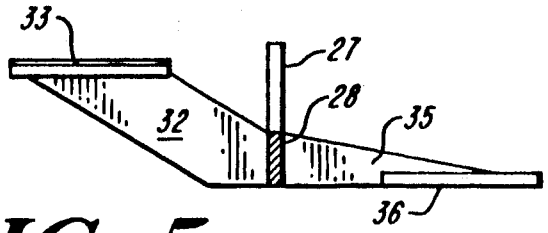
FIG. 5 is a cross-sectional detail taken along line 5—5 of FIG. 4.

The instep assembly 16 includes a torsional rigidity bar 26 which is essentially U-shaped in plan view as illustrated in FIG. 4 and is shaped to resist deflections normal to the plane of the fibers. One end of bar 26 comprises upwardly extending arm 27 integrally connected at its upper end to the rigid heel frame 19 and at its lower end to a bight section 28. The bight section 28 extends forwardly through the instep region of the midsole along the lower portion of the midsole region and is continuous with an upwardly extending arm 29 at its other end. Positioned along the torsional rigidity bar 26 and extending laterally outwardly therefrom are means in the instep or arch region that provide torsional rigidity and support against pronation. Extending from the medial side 30 are a plurality of pronation resisting components. These components are each formed with a cantilever 32 having a lower end integral with and rigidly secured to the bar 26. The end of each cantilever 32 remote from the torsional rigidity bar 26 is integrally formed with a pad 33. As best illustrated in FIG. 3, the pads 33 which function as torsion rigidity bars are shaped to conform with the outline of the midsole construction, with the foremost pad 33 projecting slightly beyond the rearmost pads 33. The upper surface of the pads 33 may be contoured, shaped and angled to conform with the specific upper surface of the midsole for which the shoe is being designed and may, if desired, have slightly curved or contoured upper surfaces. Other torsion rigidity bars in this combination are also contemplated.

On the lateral side of the torsional rigidity bar 26, there is provided a lateral support system 34 which provides support or resistance against supination. In this arrangement, a plurality of cantilevers 35 are integrally formed at one end with the lateral side of the torsional rigidity bar 26. These cantilevers 35 are aligned opposite to one each of the cantilevers 32. The cantilevers 35 are angled downwardly with the outer ends of the cantilevers 35 having integrally formed thereon pads 36 which face downwardly and are designed to engage the upper surface of the outer sole or underlying support structure (illustrated in dotted outline in FIG. 4). The pads 36 as illustrated in FIG. 2 may be appropriately contoured and shaped to conform with the lateral periphery of the midsole construction.

The torsional rigidity bar 26 and its connected cantilevers 32 and 35 and their associated pads 33 and 36 are all preferably integrally formed of a single piece of material suitable to impart torsional rigidity, stiffness and resilience to the structure of the shoe. The assembly may be formed of an appropriately molded plastic or metal.

The forefoot assembly 17 comprises a rigid or relatively stiff annular frame 37 preferably formed of the same material of which the torsional rigidity bar is formed, and similar to the rigid heel frame, is integrally formed with the intermediate torsional rigidity bar 26. This rigid annular frame 37 comprises a flange having a width preferably similar to the width of the rigid heel frame 19 and having a shape with sides conforming to the outline of the midsole construction. The forward wall 38 of the frame 37 preferably extends across the midsole construction in the toe region while the rear wall 39 of the frame is angled from the side walls 40 to a common juncture with the upwardly extending arm 29 of the bar 26. An open volume or area 41 defined by the walls 38, 39 and 40 has a plurality of fibers 42 extending laterally across the sole's structure to resiliently support the forefoot of the shoe wearer. Alternately, additional fibers (not shown) may be arranged orthogonally to fibers 42. These fibers 42 are preferably secured parallel to one another. The fibers should have a tensile strength and be spaced sufficiently close together to provide the desired resilient spring-like support for the weight of the user under dynamic conditions. These fibers may be in the order of ⅛ to ¼ inch apart in a typical application. The fibers are suitably anchored at their ends to the side walls 40 to assume that they are maintained under tension. The heel, instep and forefoot assemblies 15, 16 and 17 may, as previously noted, be integrally formed in a single injection molding step to provide an integrated system for imparting motion control stability against pronation or supination and cushioning during normal gait and running under various conditions. The assemblies 15, 16 and 17 may be incorporated into a midsole shown in outline form 43 in FIG. 3 with an outer sole 46 also shown in dotted outline in FIG. 4.

Figure 6:
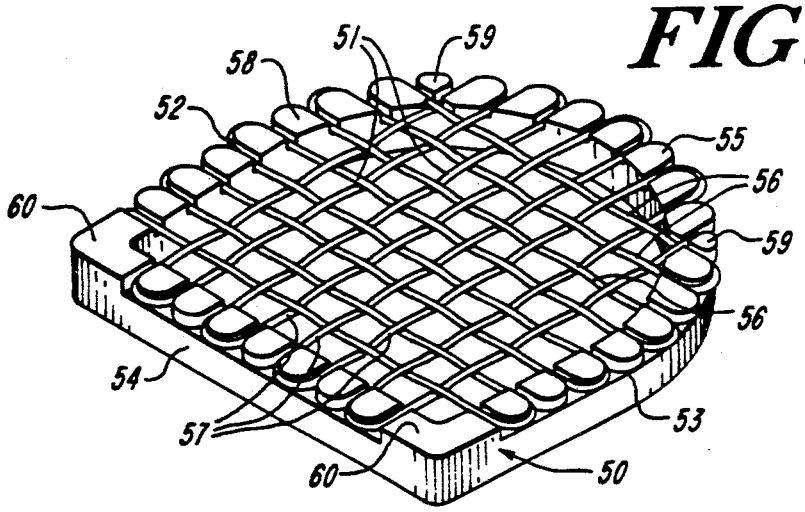
FIG. 6 is a perspective view of a heel component illustrating another embodiment of the invention.

An alternate rigid frame is illustrated in FIG. 6. This rigid frame may be formed of the same materials as rigid frame 1 (FIG. 1) and may be used in the same assembly as described with respect to heel assembly 15 in connection with FIGS. 2 through 5. The rigid frame is formed with annular wall 50 having opposite sides 52 and 53 a forward side 54 and a curved side 55 conforming with the contour of the heel. An elongated fiber or monofilament 51, made of suitable material such as gut or nylon, may be strung and woven as illustrated in FIG. 6 with a series of cross filaments 56 interwoven with longitudinally extending filaments 57. The monofilament 51 is appropriately anchored by suitable means at one location and then woven around the parallel projecting bosses 58 which extend upwardly from the upper surface of the rigid frame 50 providing suitable end supports for the fiber. These bosses 58 are generally similar in construction except for bosses 59 which define corners in a series of bosses and permit the transition of the monofilament 51 from a lateral to a longitudinal direction. The frame is also provided with a pair of shoulders 60 that project from the surface of the frame to form a uniform smooth upper surface adapted to support a lining or insole construction. The frame may be secured to underlying support in the midsole as illustrated in FIGS. 2 or 4 by suitable means such as cement or the like.

Figure 7:
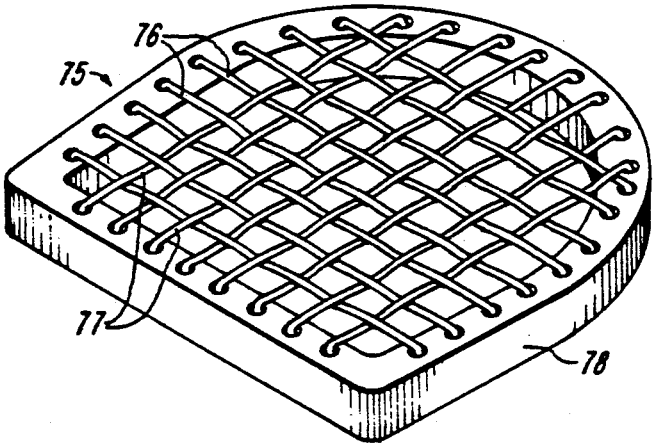
FIG. 7 is a perspective view of a heel component illustrating yet another embodiment of the invention.

The rigid frame 75 of FIG. 7 is similar in purpose to the rigid frame illustrated in FIG. 6. This frame 75, however, is formed with a plurality of filaments 76 and 77 which extend respectively laterally and transversely across the opening defined by the wall 78 of the rigid frame 75. These filaments 76 are suitably interwoven to define a web having apertures in the order of ±⅛ inch and provide suitable tension and tightness because their respective ends are locked into the upper surface of wall 78.

Figure 8:
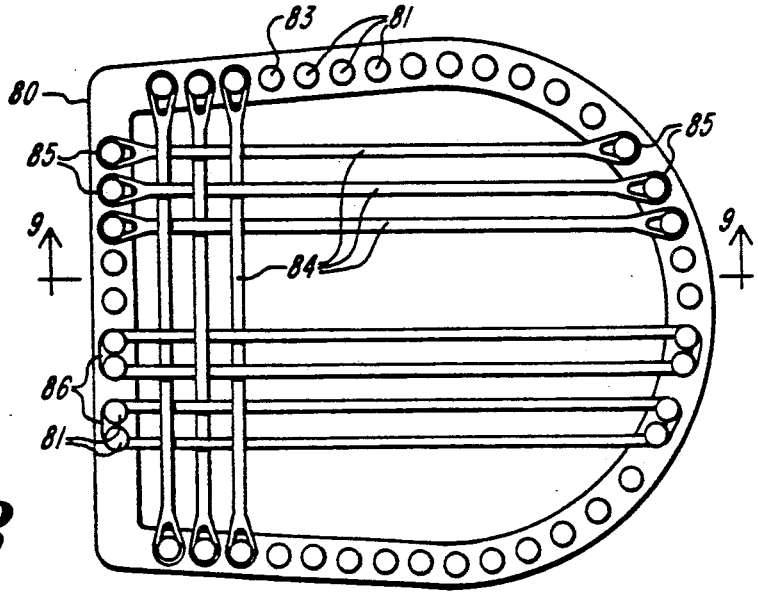
FIG. 8 is a top-plan view of a heel component partially assembled illustrating still another embodiment of the invention.

The embodiment illustrated in FIGS. 8 and 9 is intended to provide a function similar to the embodiments of FIGS. 6 and 7. In this embodiment, the heel component is formed with a rigid annular frame 80 shaped, as previously described, to be secured to the upper surface of a midsole construction at the heel portion over an opening aligned with and shaped similar to the opening defined by the annular frame 80. The rigid frame is formed with a series of bosses 81 projecting upwardly from the upper surface of the frame. The bosses 81 are each formed, as illustrated in FIG. 9, with a shank 82 and enlarged head 83 at uniform distances about and extending upwardly from the frame 80. Stretched over opposite pairs of aligned bosses 81 are a series of fibers, preferably monofilaments 84, formed with loops 85 at their respective ends. These loops 85 are shaped, sized and located to snap over opposite bosses 81 and are secured with the individual monofilaments 84 under longitudinal tension. The network of monofilaments 84 form a spring-like resilient grid or network. If desired, instead of using a monofilament 84 with integrally formed loops 85 at each end, as partially illustrated in FIG. 8, the filaments may be formed as endless loops 86 adapted to snap over and engage adjacent bosses 81 as also illustrated in FIG. 8.

FIGS. 10 and 11 illustrate another embodiment of the invention in which the rigid frame 90 is formed with an annular wall member having medial and lateral sides 91 and 92 respectively interconnected by forward and rear sides 93 and 94 respectively. These sides define an open area 95. An annular shoulder 96 is formed on the inner periphery of the sides 91 through 94. Fitted within the annular shoulder 96 and extending across the open area 95 is a molded grid 97 having a concave upper surface. The periphery of the grid 97 engages and is rigidly secured within the shoulder 96 of frame 90. The convex grid 97 is formed of a resilient material capable of deflection and return when impacted by the force of a user's foot. The rigid frame 90 may be integrally connected to a torsional rigidity bar 98 similar in construction and function to the torsional rigidity bar 26 of a previously described embodiment.

In FIG. 12 there is illustrated a rigid frame 100 which is supported on a resilient midsole substrate, preferably formed of EVA or other microcellular compressible resilient material shown in dotted outline at 101. The frame 100 and its grid or network 102 of filaments, providing a resilient support, is suitably secured be cement or other means to the upper surface of the substrate. An opening 103 in the substrate 101 immediately below the grid 102 is defined by a wall 104. This opening permits free flexing or movement of the grid 102 downwardly into the opening 103 on normal walking, running and jumping.

Figure 13:
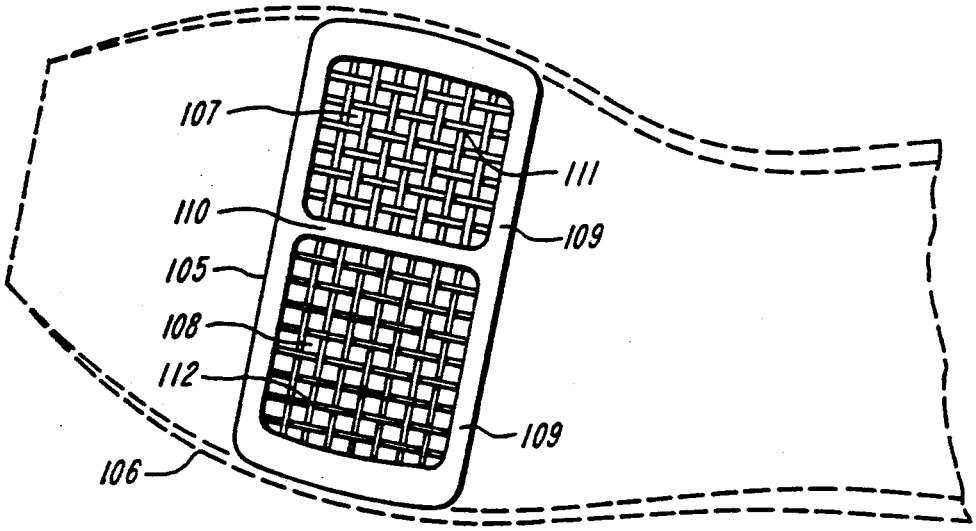
FIG. 13 is a top-plan view of a component of the invention primarily located in the metatarsal region of the midsole with the midsole shown partially in dotted outline.

Turning now to FIG. 13, there is illustrated a rigid frame 105 designed to be positioned over a substrate of an EVA, PU or other material having the configuration of a midsole and partially illustrated in a dotted outline at 106. The frame 105 is formed as a rigid member using material of the type previously described. This frame 105 is divided with two openings, including a medial opening 107 and a lateral opening 108. These openings 107 and 108 are defined by the peripheral wall 109 and from one another by a cross-wall 110. Nets 111 and 112 of monofilaments or fibers, formed as previously described, are suitably anchored under tension within the openings 107 and 108. These nets 111 and 112 are strung with the filaments across the openings 107 and 108 under different degrees of tensioning, so that greater tension may be effected on one side over the other to achieve selected performance characteristics, related to midfoot for pronation and supination. Ordinarily the net under the lateral side may be under greater tension.

Figure 14:
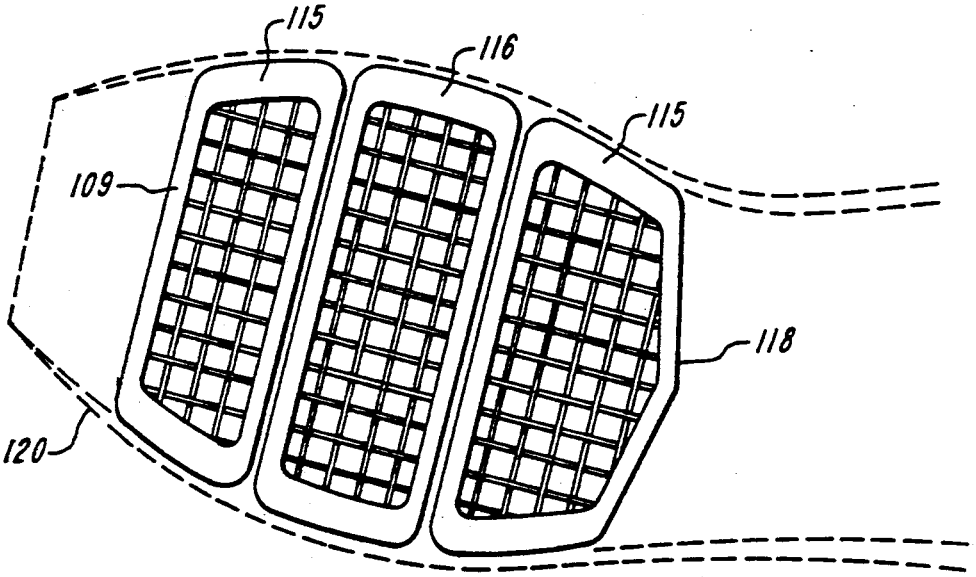
FIG. 14 is a plan view of a modification of the embodiment shown in FIG. 13.

A similar arrangement to that illustrated in FIG. 13 is illustrated in FIG. 14. Here a plurality of individual, relatively rigid frames 115, 116 and 117 having durometers of 25 Shore A to 60 Shore A in hardness are shaped and positioned sequentially from the midstep region 118 toward the toe region 119 of the midsole construction. These relatively rigid frames 115, 116 and 117 are secured to a midsole structure of the type previously described and illustrated in dotted outline at 120, by forming the forefoot support system in a plurality of frames adjacent one another. Selective string tensions for different performance characteristics may be achieved, depending upon the particular purpose of the shoe into which the system is placed and the different purpose for which the shoe is to be used.

Figure 15:
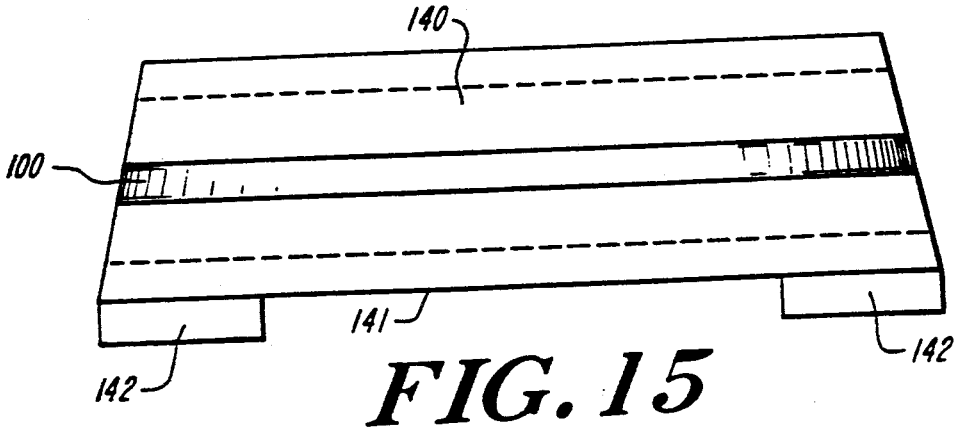
FIG. 15 is an end view of a midsole construction schematically illustrating components of the invention.

In FIG. 15, there is schematically illustrated one typical location of a resilient grid or net of the type illustrated in FIG. 12. In this arrangement, the frame 100 may be located intermediate the upper surface 140 and the lower surface 141 of a typical midsole construction. The midsole is positioned over the outersole 142. Also contemplated are arrangements in which the frame is positioned at the top as well as embodiments in which the frame is positioned at the bottom of the midsole.

Figure 16:
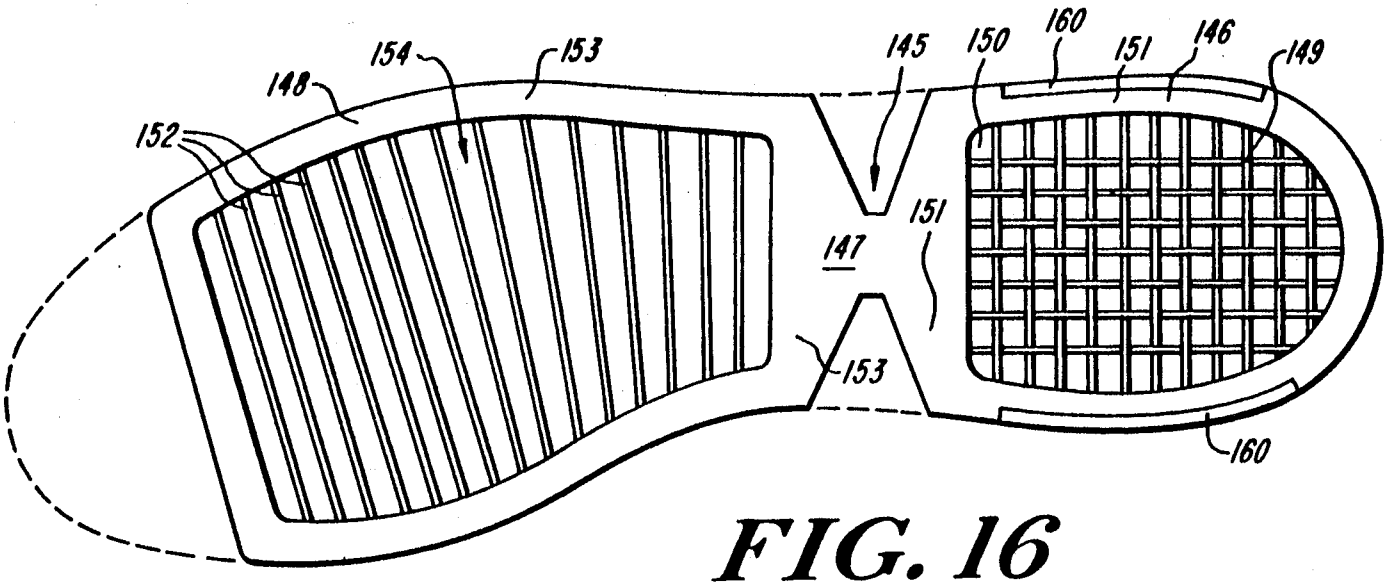
FIG. 16 is a top-plan view of a frame construction illustrating components of the invention in the heel, midfoot and metatarsal region of a midsole.
Figure 17:
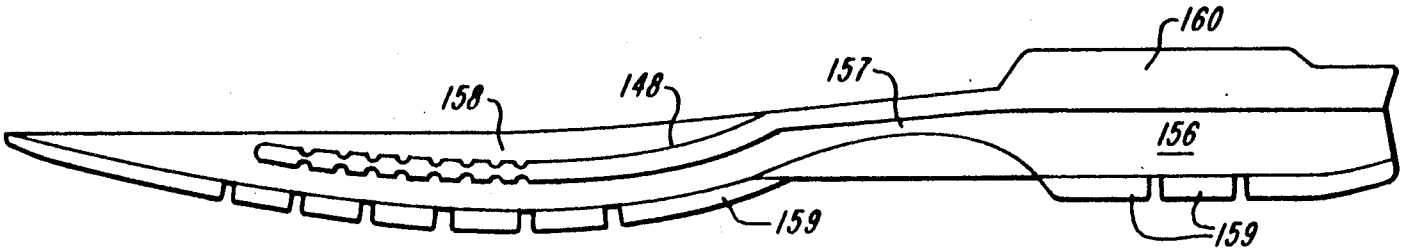
FIG. 17 is a side-elevational view of the embodiment of FIG. 16.
Figure 18:
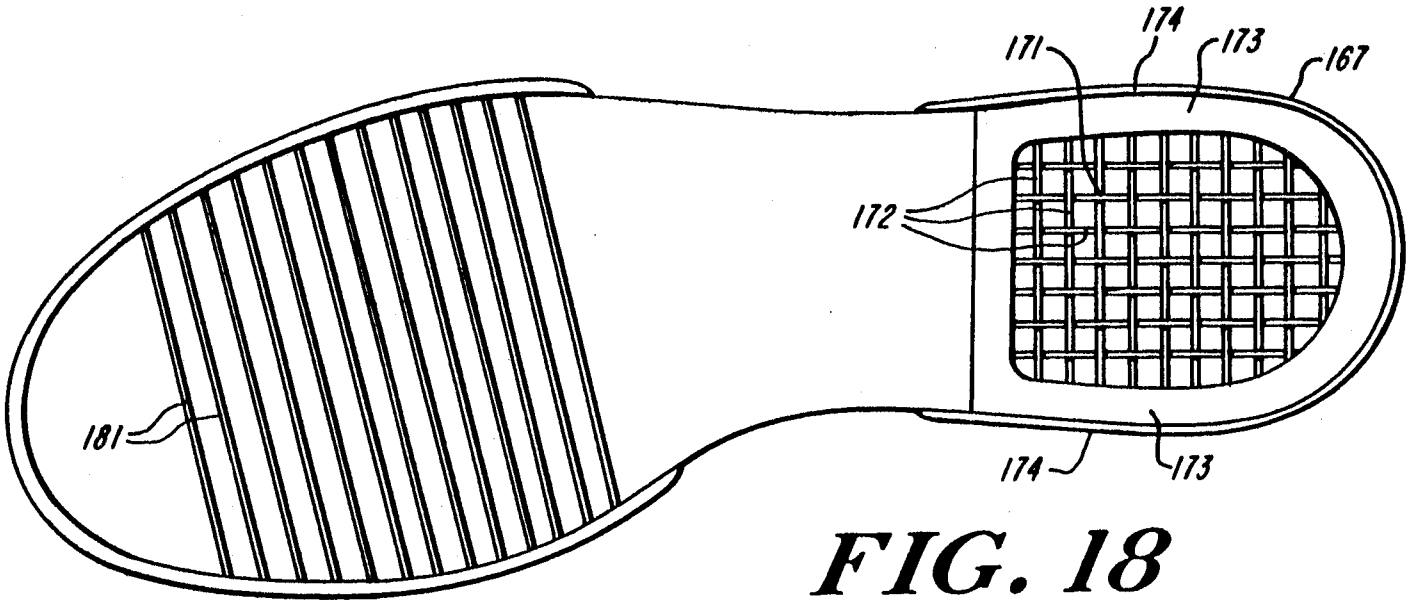
FIG. 18 is a top-plan view of still another embodiment of the present invention in a midsole construction primarily useful for court type activities.
Figure 19:
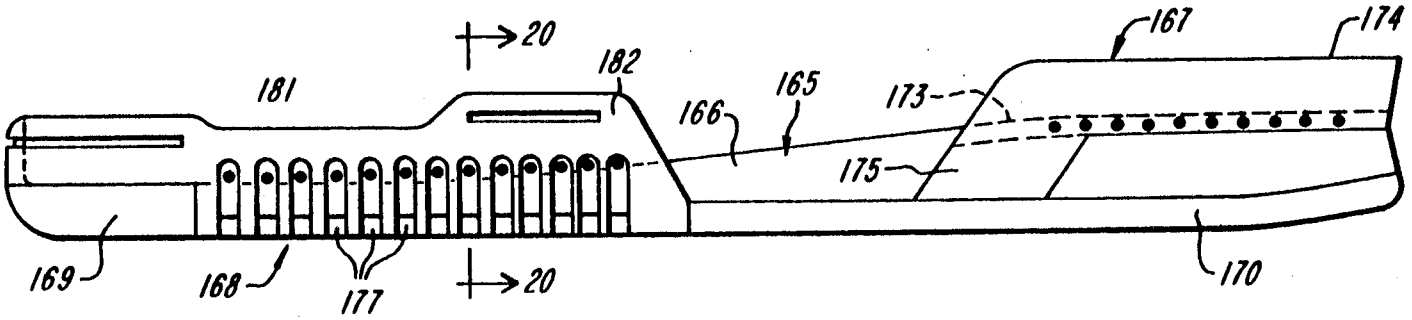
FIG. 19 is a side-elevational view of the embodiment of FIG. 18.
Figure 20:
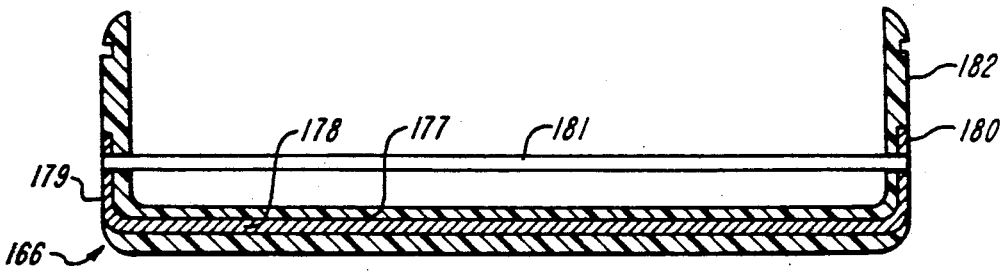
FIG. 20 is a cross sectional view taken substantially along the line 20—20 of FIG. 19.
Figure 21:
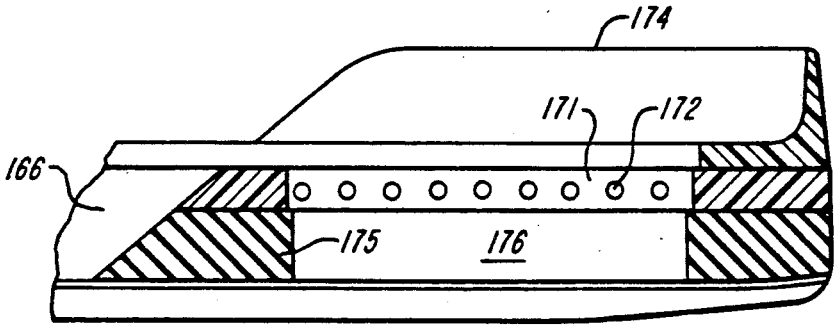
FIG. 21 is a fragmentary side elevation of a midsole illustrating a modification in the heel region of the midsole.

The frame may have a configuration generally outlined in FIG. 16 and FIG. 17. In this arrangement, the frame 145 is formed with a heel assembly 146, torsional rigidity bar 147, and forefoot assembly 148. This relatively rigid frame should be formed of material adequate to permit the grid or net 149 of filaments to be secured under tension within the open area 150 defined by the continuous side wall 151 of the frame 145 to form a heel section. Suitable means may be employed for securing the net 149 under tension. The tension should be sufficient in this embodiment, as well as in other embodiments, to support the weight of a person wearing the shoe under normal static and dynamic conditions with minimal deflection of the net or grid. The deflection under such conditions should not be greater than the depth of the open space below the open area 150. The rigid frame 145 also secures a plurality of fibers 152 substantially parallel to one another in the forefoot region of the foot. These fibers extend across the continuous side wall 153 which defines an open area 154 from the forward portion of the arch to the rear portion of the toe region. The fibers 152 are tensioned in a fashion similar to the tensioning of the fibers forming the grid 149 and provide similar support for the forefoot portion of the wearer's foot. The torsional rigidity bar 147 is continuous with and interconnects the continuous side walls 151 and 153.

As illustrated in FIG. 17, the forefoot assembly 148 has preferably a concave contour. This arrangement may be partially sandwiched or encapsulated in a resilient compressible material such as EVA or PU forming the balance of the midsole structure. This encapsulating EVA/PU includes a heel section 156, an instep section 157 and a forefoot section 158 with the forefoot section extending above and below the frame, but with openings in sections 156 and 158 below the grid 149 and fibers 152. Additionally, a series of lugs 159 may be formed about the periphery of sections 156 and 158. A motion control device in the form of upwardly extending flanges 160 may be integrally formed on the frame 145 on the medial and lateral portions of the heel assembly 146.

FIGS. 18 through 21 illustrate an embodiment particularly useful for basketball and similar sports. In this arrangement, a midsole 165 is formed of a molded core 166 heel assembly 167 and forefoot assembly 168. This midsole assembly may be integrally formed with components of an outer sole including a toe 169 and heel 170 formed of relatively noncompressible synthetic rubber sole material. The core 166 of the midsole is preferably formed of a microcellular material such as EVA having a density consistent with the densities normally used for midsoles of basketball or tennis court type shoes. The heel assembly 167, integrally formed with the molded core, is made of a relatively stiff and non-yielding material such as a high impact plastic having sufficient rigidity and structural strength to support and secure the grid or net 171 under significant tension. This grid or net 171 is formed of a plurality of fibers 172 extending laterally and longitudinally of the heel assembly 167 in an interwoven arrangement with the ends of the fibers 172 appropriately locked into the continuous side wall 173. A motion control device is formed by an upwardly extending wall 174 which is continuous with the horizontal continuous side wall 173. The wall 174 extends upwardly about the medial, lateral and rear portion of the heel, thereby forming a cup to receive the wearer's heel. The forward end of the wall 174 is continuous with downwardly extending flanges 175 on either side of the heel assembly 167. These flanges 175 fit closely to and engage the core 166 at its sides thereby reinforcing the assembly. The fibers 172 forming the grid 171 are positioned over an open area 176 (FIG. 21), which permits the grid 171 to freely deflect downwardly into an open space on the application of forces when the wearer stands on the grid. The tensions on the fibers of the grid is sufficient to limit downward deflection to a point within the open area under normal use conditions.

The forefoot assembly 168 includes a series of relatively rigid frame bars 177 that include a horizontal section 178 with parallel opposed upwardly extending ends 179 and 180. These bars 177 are rigid and essentially non-yielding and each supports a filament or fiber 181 at its end under tension. A plurality of these bars 177 are spaced closely to one another in the forefoot assembly 168 preferably from a position just forward of the instep to a position where the toe region begins. In the embodiment illustrated in FIG. 19 thirteen such bars 177 are illustrated in spaced relation. However, more or less may be used depending upon the specific structure and purpose of the shoe design. These bars 177 are secured by molding them into the midsole core 166. If desired, the midsole core may be provided with upwardly extending flanges along the medial and lateral portions of the shoe as illustrated at 182 with the upwardly extending flange designed to be permanently secured to the upper of the shoe (not shown) by conventional means. Additionally, an insole and/or sock lining may be provided over the assembly and an outer sole and heel construction may be attached to the lower surface of the core assembly 166 by conventional means.

The embodiment illustrated in FIGS. 18 through 21, as noted, is designed for basketball or like usage. The individual rigid frame bars 177 arranged in spaced relation permit forefoot flexibility while at the same time provide tension, torsional rigidity and stability.

Figure 22:
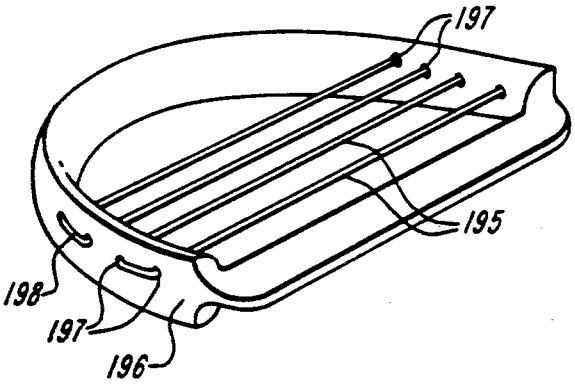
FIG. 22 is a perspective view illustrating still another embodiment of the invention.
Figure 23:
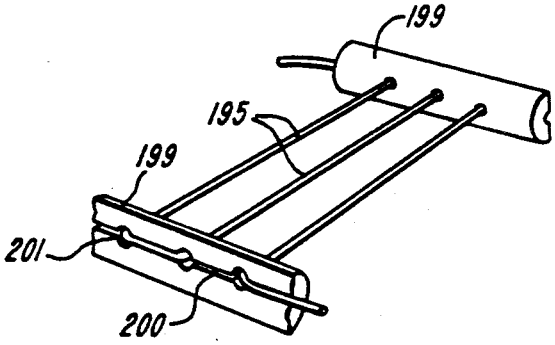
FIG. 23 is a fragmentary detail illustrating a method of knotting or tying components of the present invention.

FIGS. 22 and 23 illustrate additional means for securing a monofilament 195 under tension. In this arrangement, a rigid heel frame 196 is formed with aligned holes on both the medial and lateral side of the frame. The frame 196 may take a variety of forms or shapes intended to conform with the heel of the particular shoe for which it is designed. Intermediate the upper and lower surfaces of the frame are a plurality of holes arranged in pairs 197 with each pair aligned with a like pair of the opposite side of the frame. The filament 195 is threaded back and forth through these holes and is knotted (not shown) at its free ends with the filament maintained under tension. In order to protect the filament against abrasion, the adjacent holes in each pair may be connected by a channel or groove 198 within which a section of the filament 195 will lie. This assembly may be supported on or intermediate a midsole structure.

In FIG. 23, a similar threading arrangement is illustrated for other component sections of a shoe. In this arrangement, the side frame members 199 may form the forefoot portion of a shoe. The frame 199 may be similarly formed with longitudinally extending grooves 200 that connect a series of holes 201 through which the filament 195 is threaded. Here, the fiber is also knotted or otherwise locked at its end to provide tension of the filament sections that are intermediate the frames.

Figure 24:
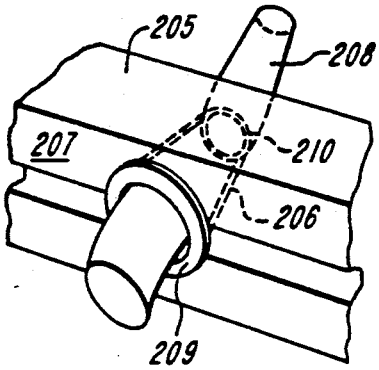
FIG. 24 is an enlarged detail showing a locking mechanism for components of the present invention.

In FIG. 24, there is shown one means for locking the fiber into a typical frame section 205. In this arrangement, the frame 205 may be formed with a hole 206 extending through the wall of the frame. Preferably, the hole has a conic shape with a larger diameter on the outside 207. The fiber or filament 208 extends through the hole 206 and through a sleeve 209 which is tapered and has essentially a conic configuration. The sleeve 209 has a narrow diameter 210 which is somewhat smaller than the normal diameter of the filament 208 thus forming a crimp at the inner end of the hole 206. The sleeve 209 is made of a somewhat resilient material such as to permit the filament 208 to be threaded through the sleeve 209 from its wider diameter to its narrower diameter. However, upon application of a force away from the inner wall which places the filament 208 under tension, the filament 208 will frictionally engage and bind at the narrow diameter 210 of sleeve 209.

Figure 25:
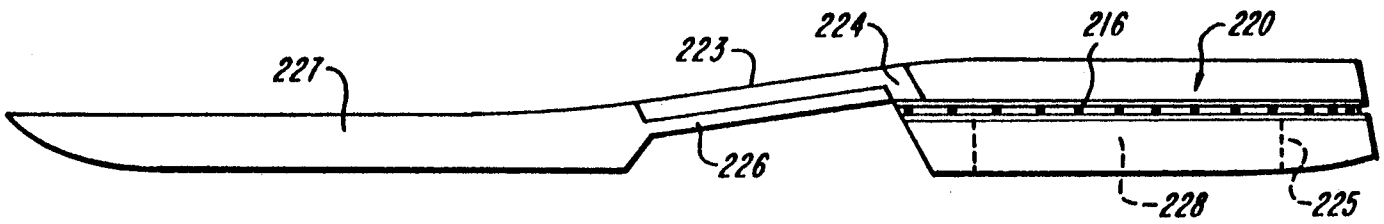
FIG. 25 is a side-elevational view of a midsole illustrating another embodiment of the invention intended for use with a torsional rigid bar in the midfoot region.
Figure 26:
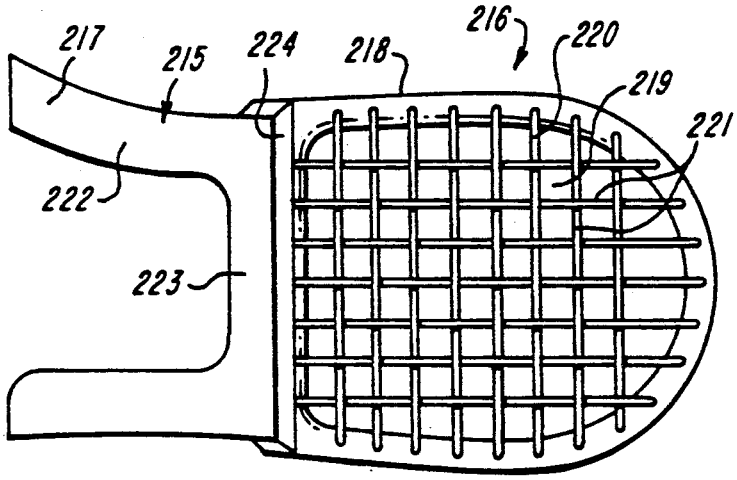
FIG. 26 is a top-plan view of one of the components illustrated in FIG. 25.

The embodiment illustrated in FIGS. 25 and 26 includes a frame 215 having integrally formed heel section 216 and instep or arch section 217. The heel section 216 is formed of a continuous wall 218 defining an open area 219. A net or mesh 220 is stretched under tension across the open area with the ends of the individual filaments 221 that form the mesh suitably anchored in the side walls 218 to form a resilient shock absorbing cushion that imparts energy return to forces applied to the net 220. The filament 221 may be suitably secured in the wall 218 by means previously discussed.

The heel section 216 is continuous with the instep section 217, and preferably is integrally formed with it. As illustrated the instep section is formed with a pair of forwardly projecting bars 222 and 223 respectively on the medial and lateral sides of the shoe construction. The bars 222 and 223 are upwardly offset from the heel section 216 by an integral web 224. The component illustrated in FIG. 26 is integrally molded into a midsole construction that includes a microcellular foam body having a heel section 225, a midfoot section 226 and a forefoot section 227 appropriately shaped to conform with the sole of the shoe, as illustrated in FIG. 25. An opening 228, illustrated in dotted outline, in the heel section 225 below the net 220 permits downward unrestrained deflection of the center of net 220.

Figure 27:
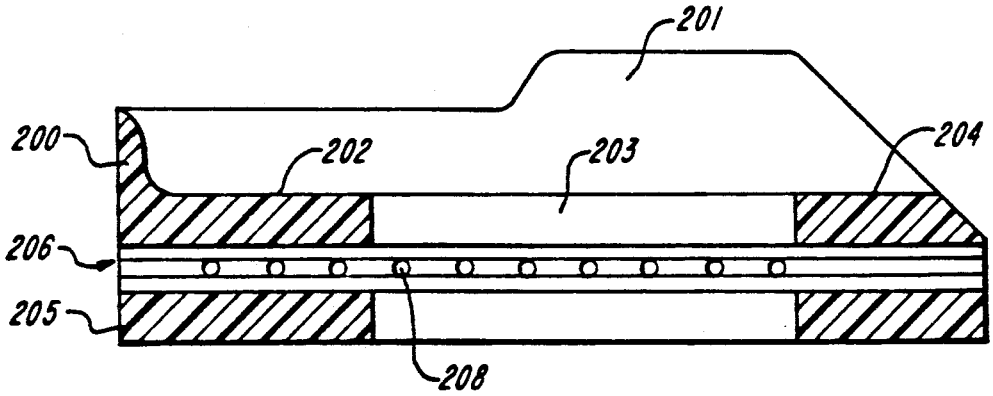
FIG. 27 is a cross sectional view of a further modification similar in some respects to FIG. 1, the cross section taken longitudinally of the unit.

FIG. 27 illustrates a further embodiment of the invention employed in a rigid heel frame. In this arrangement the rigid heel frame is similar in overall construction to the embodiment of FIG. 1. However, the fibers forming the grid or net are embodied in a flexible matrix. As illustrated, the frame has an upwardly extending flange or sidewall 200 about its periphery from the lateral side about the heel forwardly to the forward portion of the heel on the medial side of the arch. If desired a motion control device 201 may be incorporated into the flange 200 in the forward portion of the heel area. An inwardly extending flange 202 continuous with the lower edge of sidewall 200 defines an open area 203. The forward end of the open area 203 is defined by a lateral flange 204. A second component 205 similar in shape and size to the flanges 202 and 204 forms the base of the heel frame. This lower component 205 is vertically aligned with flanges 202 and 204 and has the assembly 206 secured between it and the flanges 202 and 204. Assembly 206 is a preformed unit comprising a mesh or grid of nylon filaments 208 or other suitable material for making tennis racquets, which filaments 208 are embedded in extruded polyurethane (PU). The filaments may be embedded by extruding PU layers under and over the filaments 208. Thereafter individual components are die cut to form a heel shape or assembly 206.

The sandwich forming the heel assembly is then secured by suitable means such as cementing the upper and lower components to the assembly 206. The periphery of the assembly must be firmly secured to provide an appropriate firm support.

While this embodiment describes a unit using PU, the invention also contemplates using EVA in place of PU. In these embodiments use of EVA or PU having durometers of between Shore 25A and about 60A is preferable.

Having now described my invention, I claim:

1. In a shoe construction, a stabilizing rigid frame having an upwardly extending flange shaped to extend about the periphery of the heel from the medial to the lateral side thereof and defining an open area therebetween, and a plurality of fibers forming a net in said area, and means anchoring said fibers at their respective ends whereby said net defines an impact absorbing member.

2. A shoe construction as set forth in claim 1 having an inwardly extending flange at the lower edge of said upwardly extending flange, said inner edge of said inwardly extending flange defining said open area.

3. A shoe construction as set forth in claim 2 having a cross member continuous with said inwardly extending flange, spanning said frame from the medial to lateral side thereof and with one edge in part defining said open area.

4. A shoe having an energy return system formed as an integral part of a shoe midsole comprising a frame having walls defining a heel section, midfoot section and forefoot section, said frame formed of a rigid material and defining annular members in said heel section and said forefoot section, means forming spring-like nets across the openings defined by said annular members, means tautly securing the periphery of said nets, and support means for said frame comprising a resilient compressible foam material secured below and to said frame.

5. A shoe as set forth in claim 4 including a torsional rigidity bar in said midfoot section.

6. A shoe as set forth in claim 5 wherein said torsional rigidity bar is integrally formed with and interconnecting said annular members.

7. A shoe as set forth in claim 6 including stabilizing means integrally formed with said torsional rigidity bar comprising a plurality of upwardly extending cantilevers extending laterally from said bar with a pad positioned on each to support the wearer's midfoot.

8. A shoe having an energy return system formed as an integral part of a shoe comprising a frame of rigid material defining a heel section with an open area between lateral and medial segments of said heel, means supporting said frame and defining an opening below said open area of said frame a grid of fibers positioned in the plane of said open area and means securing said fibers in said open area to resist deflection in directions normal to said plane, said means for securing said grid includes a layer within which said grid of fibers is embedded, said layer comprising high impact thermosetting plastic.

9. A shoe having an energy return system as set forth in claim 8 wherein said frame includes a continuous sidewall from the lateral to the medial side thereof having horizontal and vertical flanges, said vertical flanges continuous with the outer periphery of said horizontal flanges and having a greater height along a forward end thereof, and a transverse flange extending from the forward end of the sidewall on the lateral side to the forward end of the sidewall on the medial side.

10. A shoe having an energy return system as set forth in claim 9 wherein said horizontal flanges are secured in facing relation to the periphery of said layer of flexible resilient plastic.

11. A shoe having an energy return system formed as an integral part of a shoe comprising a frame of rigid material defining a heel section with an open area between lateral and medial segments of said heel;

means supporting said frame and defining an open space below said open area of said frame, a grid of fibers positioned in the plane of said open area and a layer of flexible resilient plastic within which said grid of fibers in said open area is embedded, said layer adapted to resist deflection in directions normal to said plane, said frame also defining a forefoot section having an open area formed by an annular wall of said forefoot section, a plurality of fibers extending across the open area of said forefoot section with the ends of the fibers tautly secured in said annular wall of said forefoot section to resist deflection normal to the plane in which said fibers lie.

12. A shoe having an energy return system as set forth in claim 11 herein said frame includes an integrally formed instep assembly having a torsional rigidity bar interconnecting the portions of said frame forming said heel section and the portions of said frame forming said forefoot section.

13. A shoe having an energy return system as set forth in claim 12 wherein said torsional rigidity bar comprises an elongated member shaped to resist bending in directions normal to planes in which said fibers lie.

14. A shoe having an energy return system as set forth in claim 13 having pronation resisting means comprising cantilever means projecting laterally from said torsion rigidity bar toward the medial side of said shoe and shaped to support the medial side of a foot forward of the heel during a gait cycle.

15. A shoe having an energy return system as set forth in claim 14 wherein said cantilever means includes a plurality of cantilevers, and a pad integrally formed at the free end of each cantilever with said pads extending annularly from said cantilevers.

16. A shoe having an energy return system as set forth in claim 15 wherein said torsional rigidity bar has a U-shape with said cantilever extending radially from the bight of said bar in an upward direction.

17. A shoe having an energy return system as set forth in claim 13 having supination resisting means comprising lateral cantilever means projecting laterally from said torsional rigidity bar toward the lateral side of said shoe and shaped to resist roll over movement of the foot toward the lateral side in a gait cycle.

18. A shoe as set forth in claim 17 wherein said lateral cantilever means includes a plurality of lateral cantilevers and a pad integrally formed at the free end of each lateral cantilever with said pads extending annularly from said lateral cantilevers.

19. A shoe as set forth in claim 11 wherein said frame includes an integrally formed instep assembly interconnecting portions of said frame forming said heel section and said forefoot section and pronation and supination resisting members integrally formed with said instep assembly.

20. A shoe as set forth in claim 19 wherein said pronation and supination resisting members include a plurality of cantilevers extending laterally from either side of said instep assembly, said cantilevers on the lateral side of said instep assembly forming the supination resisting members and said cantilevers on said medial side of said instep assembly forming said pronation resisting members.

21. A shoe having an energy return system formed as an integral part of the shoe comprising a frame of rigid material and defining an open area, means supporting said frame over a sole member, said sole member having an opening below and in alignment with said open area, a grid of fibers positioned in the plane of said open area and means securing said fibers in said open area to resist deflection in directions normal to said plane.

22. A shoe having an energy return system as set forth in claim 21 wherein said frame defines a plurality of distinct open areas and a plurality of grids of fibers and means separately supporting a grid in each of said open areas.

23. A shoe as set forth in claim 22 wherein said open areas are positioned in the forefoot of said shoe.

24. A shoe as set forth in claim 23 wherein said open areas are arranged with one on the lateral and the other on the medial side of said shoe.

25. A shoe as set forth in claim 23 wherein said open areas are arranged in successive longitudinal alignment.

26. In a shoe construction having an energy return system, a plurality of elongated fibers extending across said shoe and positioned to support the weight of the foot, and mans supporting said fibers including a plurality of U-shaped members having legs with the ends of each fiber secured to each of said legs with the bight of said U-shaped members each parallel to and spaced from a fiber.

* * * * *